United States Patent [19]

Page

[11] 4,321,107

[45] * Mar. 23, 1982

[54] METHOD OF SUPPRESSING PAPER WEB FLUTTER

[75] Inventor: Robert E. Page, Davis, Ill.

[73] Assignee: Beloit Corporation, Beloit, Wis.

[ * ] Notice: The portion of the term of this patent subsequent to Dec. 18, 1996, has been disclaimed.

[21] Appl. No.: 76,611

[22] Filed: Sep. 18, 1979

Related U.S. Application Data

[63] Continuation-in-part of Ser. No. 939,462, Sep. 5, 1978, Pat. No. 4,179,330.

[51] Int. Cl.[3] ..... D21F 11/00

[52] U.S. Cl. ..... 162/198; 162/202; 226/7; 226/97

[58] Field of Search ..... 162/113, 122, 197, 198, 162/199, 252, 263, 272, 281, 283, 361, 202; 242/65; 226/7, 97; 26/51; 156/183; 100/42, 47, 163 A, 176, 172, 173

[56] References Cited

U.S. PATENT DOCUMENTS

| | | | |
|---|---|---|---|
| 3,452,447 | 7/1969 | Gardner | 34/156 |
| 3,813,019 | 5/1974 | McAnespi et al. | 226/97 |
| 3,846,228 | 11/1974 | Ely et al. | 162/206 |
| 3,847,390 | 11/1974 | Dixon | 271/195 |
| 4,087,319 | 5/1978 | Linkletter | 162/113 |

*Primary Examiner*—Peter Chin

*Attorney, Agent, or Firm*—Hill, Van Santen, Steadman, Chiara & Simpson

[57] ABSTRACT

Web flutter is suppressed by means of one or more foils along the path of movement of the web which may be porous, such as tissue, whether creped or not, or may be substantially non-porous. For porous web, the foil may be imperforate. For non-porous web, the foil may be foraminous. As the web travels at high speed in adjacently spaced relation to the foil, surface air pressure tends to be greater on the surface of the web opposite the web surface which faces the foil, thus tending to thrust the travelling web toward the foil, and thus stabilizing web travel and suppressing tendency for the web to flutter as it travels freely between supports such as a dryer and a calender.

7 Claims, 3 Drawing Figures

Fig. 1
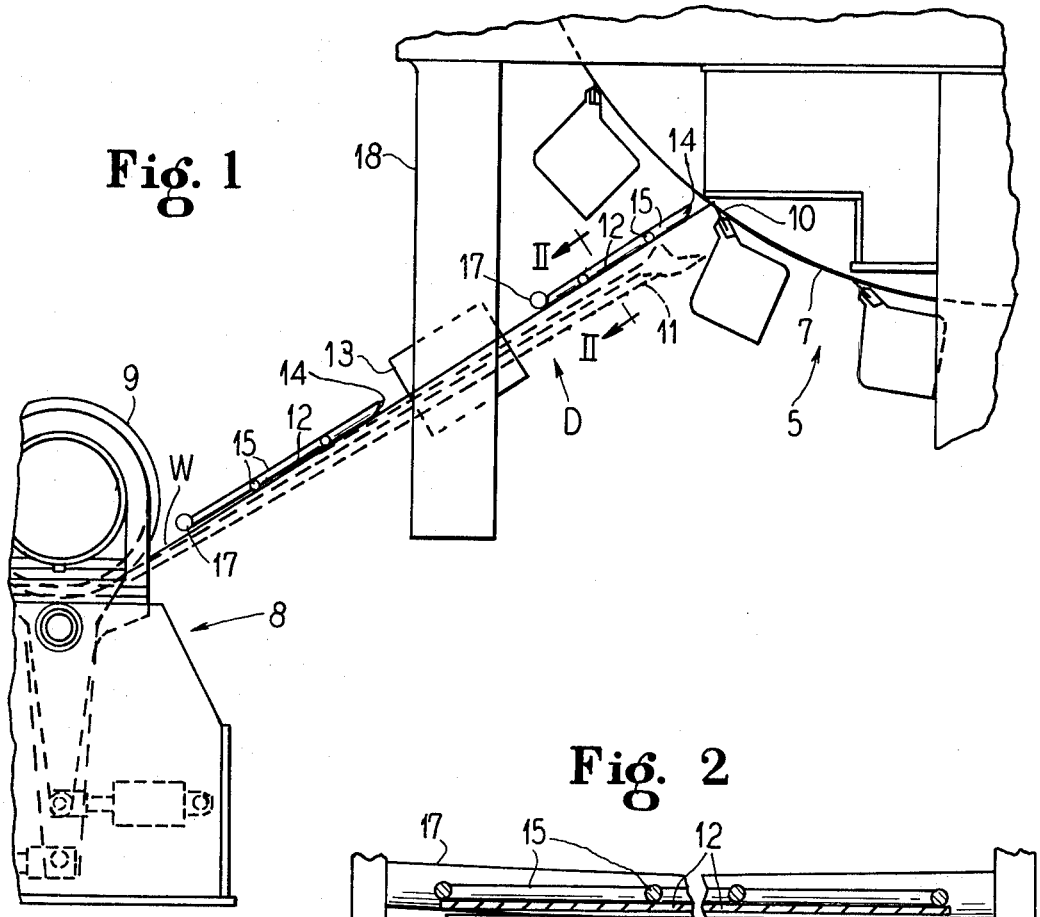
Fig. 2
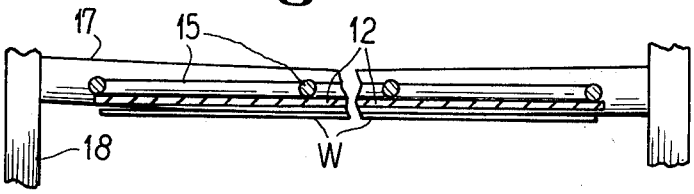
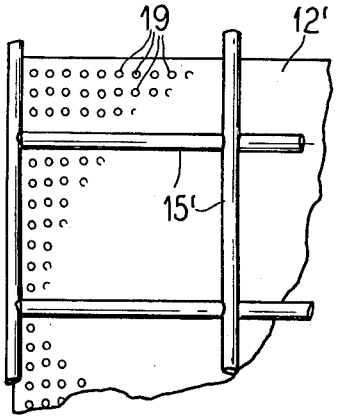
Fig. 3

METHOD OF SUPPRESSING PAPER WEB FLUTTER

RELATED APPLICATION

This application is a continuation-in-part of my copending application Ser. No. 939,462 filed Sept. 5, 1978, now U.S. Pat. No. 4,179,330 issued Dec. 18, 1979.

BACKGROUND OF THE INVENTION

This invention relates to the handling of web material between spaced web handling means such as between a dryer, or the like, and a calender, or the like, and is more particularly directed to new and improved apparatus for and method of suppressing flutter during high speed operation with thin, light weight paper web such as tissue paper.

Serious limitations have heretofore been encountered in the speed at which web material such as tissue paper, plain or creped could be handled. Because of its light weight and frangible nature tissue paper web has been prone to break in unsupported generally horizontal open draws such as between the dryer and calender.

Direct support of the traveling web on a stationary member produces a drag force and strain on the web, which reduces the crepe where creped tissue is being handled. On the other hand, rotary transport members tend to function as air transport pumps by inducing a corotating band of air which is interposed between the rotating member and the web, and this contributes to web instability as it travels over the rotating members. An additional problem with supporting traveling webs on rotating members is that the so called "table roll effect" (i.e. the tendency of the traveling web to follow the surface of the rotating roll and thus wrap the roll, at which point the web is, of course, broken) produces strain in the web which can cause the web to flap and break. Frequently the broken web then wraps the rotating roll and must be cut off and rethreaded before operation can be resumed.

If the web is left unsupported, stray air currents and even tension wrinkles in the web will cause the web to become unstable and the resulting flutter and strains in the web eventually cause it to break.

SUMMARY OF THE INVENTION

The aim of the present invention is to overcome the problems, disadvantages, drawbacks, inefficiencies, and shortcomings inherent in prior apparatus and methods for handling thin, light weight material such as tissue paper.

After tissue paper has been dried sufficiently to be self-sustaining, such as on a Yankee dryer roll or any other preferred drying means, and whether creped as by doctoring on the Yankee drying roll, or not, the relatively fragile paper web must travel some distance from the dryer to apparatus downstream from the dryer at which the web may be further processed or may be simply wound. Generally, it is desirable to lightly calender the tissue for bulk uniformity such that resulting toilet tissue rolls will attain uniform diameter or that boxed tissue will uniformly fill a predetermined size box.

According to the present invention running speeds of over 4000 ft. per minute are accommodated by effectively suppressing flutter of the web in a draw span between the dryer and further web handling means such as a calender or other handling means.

To the attainment of this important result, the invention provides a method of handling a high speed continuously running paper web, comprising running the web in a generally horizontal free draw span between substantially spaced web handling means, in said draw span running the web along and in adjacently spaced facing relation to foil means comprising a plate elongated in the direction of web travel and extending throughout a major portion of the span between said handling means and having a face in a plane extending across and longitudinally along and in adjacently spaced substantially parallel relation to one face of the web, leaving the remaining face of the web facing an open space in said draw span, and simply by the unaided running of the web in said relation to said plate face reducing and stabilizing the boundary layer of air between said high speed running web and said plate face and thereby suppressing tendency of the web to flutter.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

IN THE DRAWINGS

FIG. 1 is a fragmentary schematic side elevational view of apparatus embodying principles of the invention.

FIG. 2 is an enlarged fragmental sectional detail view taken substantially along the line II—II of FIG. 1; and FIG. 3 is a fragmentary top plan view of a modified form of flutter suppressing foil.

DESCRIPTION OF PREFERRED EMBODIMENTS

On reference to FIG. 1, a web W which may be a tissue paper web runs continuously at high speed across a generally horizontal (and which as shown includes substantial deviation from true horizontal) free draw span D between spaced web handling means such as a dryer 5 which may be in the form of a so-called Yankee dryer roll 7 to other handling means such as a calender 8 having a calender roll 9. Although the web W may leave the dryer roll 7 as substantially flat tissue, the web may be creped as by means of a creping doctor 10. During start-up, an advancing tail terminal is fed into the mouth end of a pneumatic sheet conveyor 11 which may be constructed as and functions in accordance with the disclosure in U.S. Pat. No. 3,847,390 which is incorporated herein by reference. The sheet conveyor 11 may take other forms such as ropes, tapes, vacuum sheaves, or other air transport systems for advancing the web to the calender 8. From the calender roll 9, the web W may pass on to any other desired web treating or handling mechanism.

Even though it may be necessary to have the open draw span D in the system between the handling mechanisms 5 and 8, it is an important feature of the present invention to transfer the web W at high speed from the mechanism 5 to the mechanism 8 despite tendency of tissue web, whether or not creped, to flutter at high speed while traversing an open draw. Heretofore, speeds up to 4000 fit. per minute have been deemed a practical limit. By suppressing flutter of the web W as it travels the open draw D between the mechanisms 5 and 8, speeds well over the 4000 ft. per minute are attainable, according to the present invention, with greatly diminished web breaking possibility. To this end, flutter suppressing means comprising one or more suppressor foils 12 are located so that the web W travels along the foils in the open draw substantially flutter-free at high speed. Although a single flutter suppressing foil may be employed throughout substantially the entire length of the draw span D, in the present instance, two of the flutter suppressing foils 12 are shown, with a cross-machine basis weight scanner 13 intervening between the foils 12 for monitoring such factors as basis weight and moisture of the web. Such scanners are well known and therefore need not be further described herein.

Each of the flutter suppressing foils 12 preferable comprises a substantially flat plate which extends across the full width of the web W and is located at an elevation desirably parallel to and slightly above the path of travel of the web W as it is drawn across the relatively short draw span D between the drying roll 7 and the calender roll 9. In the preferred relationship, the flutter suppressing foil 12 overlies the web W, thereby facilitating removal of broke in the rather minimal possibility of a web break, but if desired, the foil 12 may be located under the web. In any event, the operating spacing between the foil 12 and the web W should be adjusted to the minimum that is practical for the particular web being handled, and just a great enough spacing to at least minimize slap and avoid direct frictional engagement between the foil and the web. Thereby, the foil 12 functions by itself and without supplemental air to reduce and stabilize the boundary layer of air between the web sheet and the foil. This effectively suppresses tendency of the web to flutter, such as is commonly experienced where no control on boundary layer air is present.

At its upstream end, the foil 12 is desirably formed with a lead-in cam surface 14 turned away from the plane of the adjacent web path of travel. Although the plate material of which the foil 12 is made, may in and of itself be thoroughly rigidly self-sustaining, thinner gauge material may be employed and suitably reinforced such as by means of integral ribs or by means of reinforcing rods 15 fixed to the face of the panel or plate in any suitable manner as by welding where the plate is metal. In a desirable arrangement, the reinforcing rods 15 may be affixed to the foil 12 in a grid pattern extending both longitudinally and transversely of the plate and on the face of the plate opposite to its flutter suppressing face which controls the boundary layer of air along the face of the web W.

In a preferred construction, the flutter suppressing foils 12 are mounted in the associated machine in association with sheet spreader means in a desirable form comprising in each instance a slightly bowed spreader bar 17. Each of the spreader bars 17 may be supported at its opposite ends on suitable parts of machine frame 18. Thereby the spreader bars 17 are adapted to provide cantilever support for the foils 12 which extend upstream from the bars. Through this arrangement, not only is the web W maintained substantially free from flutter while travelling at high speed between the dryer roll 7 and the calender roll 9, but the web is maintained thoroughly spread against any tendency to contact or fold over at the margins. In addition, the spreader bars 17 contribute to maintaining a spaced relation between the high speed travelling web W and the foils 12, so that close operating spacing between the foils and the web is facilitated.

Where the web W comprises porous paper, the boundary layer air between the travelling web W and the foil 12 bleeds through the web W so that the pressure on the outside of the web (that side of the web which faces away from the foil) is slightly greater than the pressure between the web W and the foil 12, and this pressure differential thus urges the web to remain in proximity to the foil and suppresses any tendency which the web may have to flutter in the draw span D. In FIG. 2, the foil 12 is shown as of the imperforate type suitable for suppressing flutter in porous web. For successfully suppressing flutter where the web is relatively non-porous, the air between the web and the foil may not normally bleed through the web, or at least not bleed through the web fast enough to create a desirable pressure differential to effect flutter suppressing guidance of the web along the spaced foil face. Therefore, the foil may be adapted for such relatively non-porous web, in the manner depicted in FIG. 3, where the foil 12' is foraminous and has a pattern of relatively closely spaced small holes 19 through which the boundary layer air bleeds, whereby to effect substantially the same pressure differential as were the web is porous and the foil is imperforate. The size and distribution of the holes 19 should be selected to attain the optimum pressure differential for the particular character of the imperforate web being handled. The result should be that the air pressure on the outside face surface of the web is greater than the air pressure between the web and the foil whereby to urge the web to travel substantially uniformly along the foil.

It will be understood, that the relative spacing between the foil 12, 12' and the web W, the length of foil or the number of foils which will attain the optimum result should be calculated in view of various parameters such as the web basis weight, machine speed, relative degree of porosity of the web, moisture content, angle of inclination of the foil, and the like, for each installation. As pointed out, attainment of optimum pressure differential for suppression of non-porous web flutter may also require calculation of the air transfer capability or porosity of the flutter suppressing foraminous foil or foils.

It will be understood that variations and modifications may be effected without departing from the spirit and scope of the novel concepts of this invention.

I claim as my invention:

1. A method of handling a high speed continuously running paper web, comprising:

running the web in a generally horizontal free draw span between substantially spaced web handling means;

in said draw span running the web along and in adjacently spaced facing relation to foil means comprising a plate elongated in the direction of web travel and extending throughout a major portion of the span between said handling means and having a face in a plane extending across and longitudinally along and in adjacently spaced substantially parallel relation to one face of the web;

leaving the remaining face of the web facing an open space in said draw span;

and simply by the unaided running of the web in said relation to said plate face reducing and stabilizing the boundary layer of air between said high speed running web and said plate face and thereby suppressing tendency of the web to flutter.

2. A method according to claim 1, comprising running said web through said free draw span with one face directed upwardly, and mounting said foil means plate above said web and with said one face of the plate facing downwardly toward said upwardly facing web face.

3. A method according to claim 1, comprising subjecting the running web to sheet spreading bar means mounted in association with said flutter suppressing foil means plate.

4. A method according to claim 1, which comprises scanning the basis weight and determining the moisture content of the web at an intermediate point in said draw span between an upstream flutter suppressing foil means plate and a downstream flutter suppressing foil means plate.

5. A method according to claim 1, comprising subjecting the web to a plurality of the flutter suppressing foil means plates mounted in cross machine operative relation and spaced from one another longitudinally along said draw span.

6. A method according to claim 1, which comprises providing said flutter suppressing foil means plate as an imperforate member where the web is porous and bleeding boundary layer air from between said web and said plate face through the porous web.

7. A method according to claim 1, which comprises providing said flutter suppressing foil means plate as a foraminous member, and effecting boundary layer air transfer therethrough, whereby to accommodate a substantially non-porous web.

* * * * *